United States Patent [19]

Perry

[11] 4,398,655

[45] Aug. 16, 1983

[54] BELT HOLSTER COMBINATION

[75] Inventor: Wilbert O. Perry, Bunnlevel, N.C.

[73] Assignee: Bangor Punta Corporation, Greenwich, Conn.

[21] Appl. No.: 424,723

[22] Filed: Sep. 27, 1982

[51] Int. Cl.[3] ..... F41C 33/02

[52] U.S. Cl. ..... 224/191; 224/269; 224/911

[58] Field of Search ..... 224/191, 192, 193, 206, 224/224, 226, 238, 240, 242, 243, 269, 911, 912, 198; 2/338; D2/380, 381, 382

[56] References Cited

U.S. PATENT DOCUMENTS 1,887,780 11/1932 Noel ..... 224/911 X 4,270,680 6/1981 Bianchi ..... 224/193

*Primary Examiner*—Steven M. Pollard

*Assistant Examiner*—David Voorhees

*Attorney, Agent, or Firm*—Patrick J. Walsh

[57] ABSTRACT

Disclosed is a belt and holster combination wherein the holster is removable from and attachable to the belt without opening or removing the belt from about the individual wearing the holster. The belt includes an elastic portion, adjacent opposite ends of which are carried clips which open in laterally opposite directions one from the other. The holster has a pair of laterally spaced D-loops pivotally carried by the holster body. When the belt is tensioned to stretch the elastic portion, the belt clips and holster D-loops register and are connected one with the other. The tension on the belt caused by strapping the belt about the individual's waist maintains the connection between the holster and the belt. The holster is attached to an detachable from the belt while the latter is worn by an individual simply by connecting or disconnecting each D-loop relative to its associated belt clip.

8 Claims, 6 Drawing Figures

H
16
14
10
40
12
18
52
48
50
46
18
22
20

BELT HOLSTER COMBINATION

BACKGROUND OF THE INVENTION

The present invention relates to apparatus for carrying a holster and particularly relates to a belt and holster combination for carrying a handgun wherein the holster is removable from the belt without the individual carrying the holster and handgun opening the belt or removing the belt from his or her person.

Conventional holster constructions frequently provide a loop on the backside of the holster body through which is received a belt. The belt, of course, is slipped through the loop and strapped about an individual thus enabling the holster to be carried by that person. The belt is also frequently threaded through belt loops on the individual's pants whereby it serves the dual purpose of enabling the individual to carry the holster while also providing support for the individual's pants. This arrangement, however, is somewhat inconvenient for the individual wearing the conventional holster. For example, when the individual wearing the above described conventional belt and holster arrangement wishes to remove the holster, it is necessary to first withdraw the belt from within the belt loop forming part of the holster. Thus, where the belt is threaded through the loops on the individual's pants, it is necessary to open the belt buckle and remove at least an end portion of the belt from several of the corresponding pant loops before the holster can be removed from the belt. Even after the holster is removed, the individual must then rethread the belt through the pant loops and rebuckle the belt in order to continue to use the belt for support of the individual's pants.

The converse is also a source of great inconvenience. That is, when the individual desires to wear the holster and carry a handgun, the belt must first be unbuckled and an end portion of it must be unthreaded from the corresponding pant loops before it can be inserted through the holster loop. Following that, the belt end must then be rethreaded through the pant loops and buckled. Consequently, whether removing the holster from the individual's belt or securing it thereto, the conventional belt and holster arrangement previously described can be a source of great inconvenience. There is thus an established need for a holster which can be conveniently attached to and removed from a person's belt without the concomitant inconvenience of opening the person's belt and removing at least an end portion of the belt.

SUMMARY OF THE PRESENT INVENTION

Accordingly, it is a primary object of the present invention to provide a belt and holster combination for enabling removal of the holster from the belt without opening the belt or removing it in whole or in part from the person carrying the holster.

It is another object of the present invention to provide a belt and holster combination for enabling attachment of the holster to the belt without opening the belt or removing it in whole or in part from the person carrying the holster.

It is a related object of the present invention to provide a novel and improved belt and holster combination for enabling quick, ready and easy removal of the holster from and attachment of the holster to the belt without opening the belt or removing it in whole or in part from the individual carrying the holster.

It is another object of the present invention to provide a novel and improved belt and holster combination having the foregoing characteristics wherein the belt is constructed to maintain the holster tight and close to the individual's body thus affording stability to the holster in its location relative to the body as well as adequate tension about the body thus serving the additional purpose of a conventional belt, that is, as a support for pants.

Additional objects and advantages of the present invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the present invention, as embodied and broadly described herein, apparatus for carrying a handgun according to the present invention may comprise a holster for receiving a handgun and having first and second elements spaced laterally one from the other a first predetermined distance, and a belt for carrying the holster and having an elastic portion and first and second fastening elements carried by the belt adjacent respective opposite end portions of the elastic portion and spaced laterally one from the other a second predetermined distance less than the first predetermined distance when the elastic portion lies in a relaxed condition, the first and second fastening elements carried by the belt and the first and second fastening elements carried by the holster being connected, respectively, one to the other when the belt is disposed about an individual and tensioned to stretch the elastic portion thereby to secure the holster to the belt.

Preferably, the first and second fastening elements carried by the belt include generally U-shaped clips disposed on their sides and opening in opposite lateral directions one from the other. The first and second fastening elements carried by the holster includes generally D-shaped loops spaced laterally one from the other along the backside of the holster body. When the belt is tensioned about the individual's body thus stretching the elastic portion of the belt, the belt clips pivot the D-shaped loops away from one another into their extreme positions thus maintaining the holster secured to the belt notwithstanding that the elastic portion is under tension tending to displace the belt clips toward one another. The elastic portion of the belt permits the belt clips to move toward one another when the holster is being attached to or removed from the belt thereby enabling release of the D-shaped loops from the belt clips.

The invention consists in the novel parts, constructions, arrangements, combinations, and improvements shown and described. The accompanying drawings, which are incorporated in and constitute a part of this specification illustrates a preferred embodiment of the present invention and, together with the description, serve to explain the principles of the invention.

DESCRIPTION OF THE DRAWING FIGURES

FIG. 3 is a fragmentary perspective view of the belt and holster combination hereof looking at the inside face of the holster with a portion of the belt broken out to illustrate one of the cooperable fastening elements carried by the belt and holster;

FIG. 6 is a horizontal cross sectional view of the belt in a tensioned condition about the individual's waist when the belt is used solely as a support for the individual's pants.

DESCRIPTION OF A PREFERRED EMBODIMENT

Reference will now be made in detail to the present preferred embodiment of the invention, an example of which is illustrated in the accompanying drawings.

Figure 1:
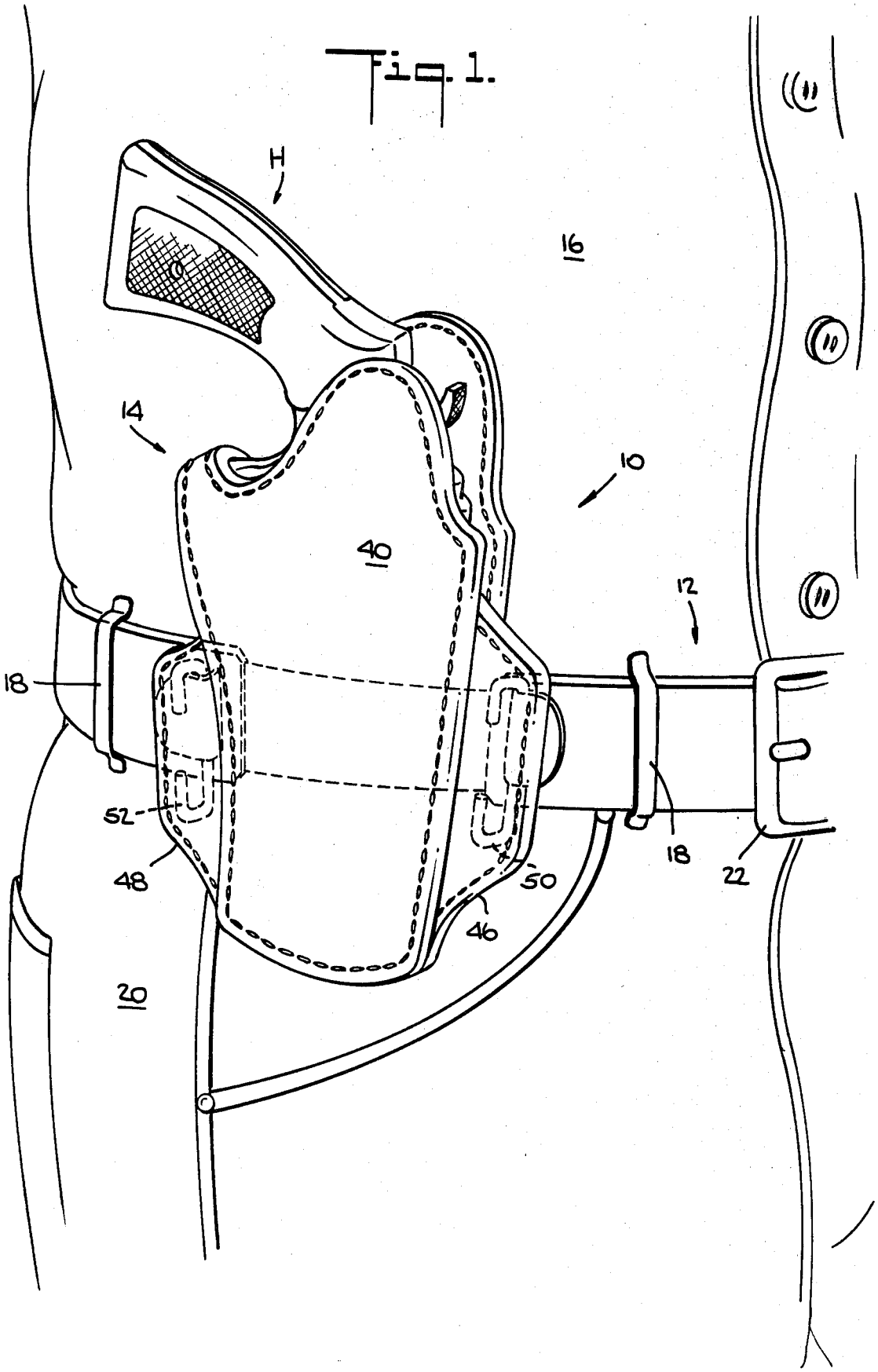
FIG. 1 is a perspective view of a belt and holster combination constructed in accordance with the present invention and illustrated about the waist of an individual.

Referring now to the drawings, and particularly to FIG. 1, there is illustrated a belt and holster combination constructed in accordance with the present invention and generally designated 10. As illustrated in FIG. 1, belt and holster combination 10 includes a belt and holster, generally designated 12 and 14, respectively, the holster being illustrated carrying a handgun, generally designated H. In FIG. 1, the belt and holster combination 10 is illustrated worn about the waist of an individual, generally designated 16, the belt 12 being threaded through loops 18 forming part of the individual's pants 20.

Figure 2:
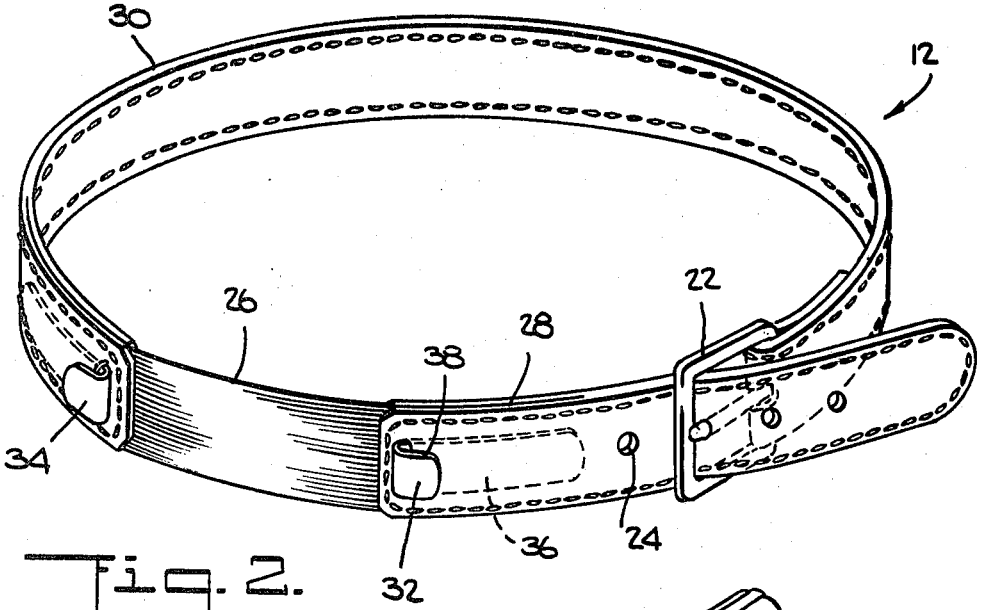
FIG. 2 is a perspective view of the belt forming a part of the belt and holster combination of the present invention.
Figure 8:
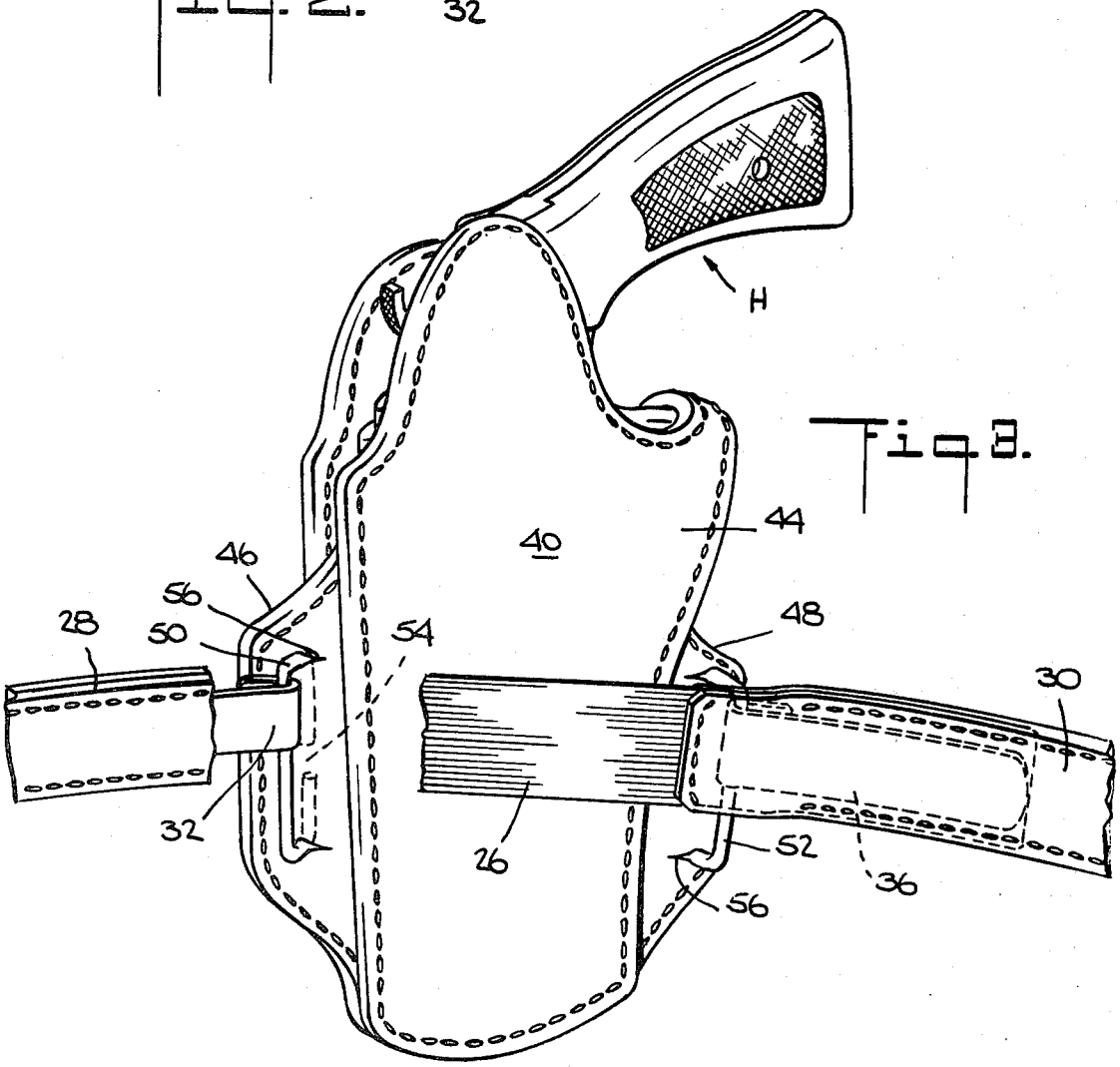

Referring now particularly to FIG. 2, belt 12 is formed of an elongated strip of material, such as leather, having a standard belt buckle 22 at one end and a series of openings 24 spaced one from the other along the opposite end of the belt whereby the belt may be buckled about and unbuckled from the waist of a individual. In accordance with the present invention, belt 12 hereof is provided with an intermediate portion 26 formed of an elastic or stretchable material. Thus, belt 12 comprises discrete belt portions 28 and 30 having adjacent ends connected one to the other by elastic portion 26, the opposite ends of elastic portion 26 being preferably stitched to the near ends of portions 28 and 30. Elastic portion 26 is located along the belt more toward the end of the belt containing belt openings 24 than toward the end of the belt carrying belt buckle 22. Thus, when the belt is worn about the waist of an individual, the elastic portion will be located at the desired location of the holster, e.g., at the right or left side of the individual.

Figure 4:
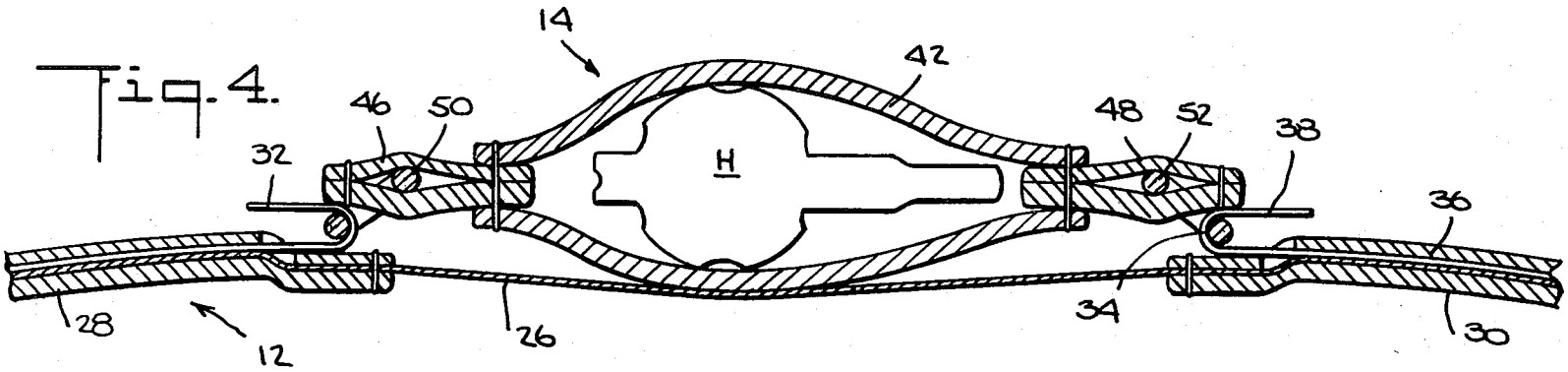
FIG. 4 is a horizontal cross sectional view through the belt and holster combination hereof illustrating the holster secured to the belt, the elastic portion of the belt under tension, and the handgun within the holster body.
Figure 5:
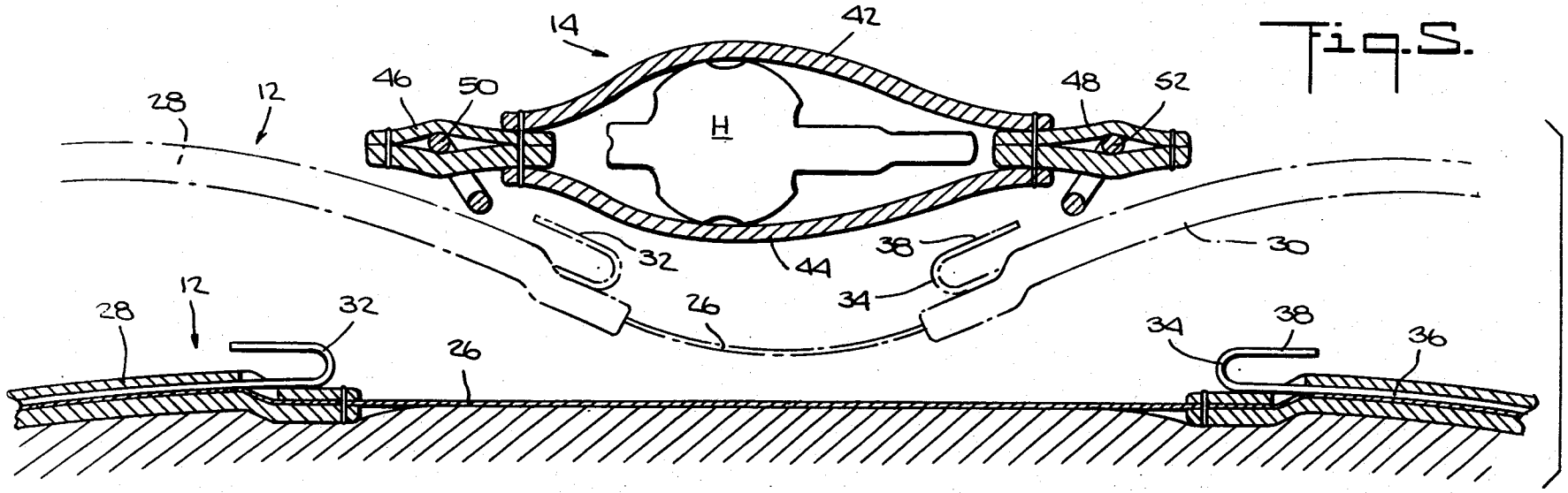
FIG. 5 is a view similar to FIG. 4 illustrating the holster detached from the belt with the elastic portion of the belt in a relaxed state.

First and second fastening elements 32 and 34 are carried by the belt portions 28 and 30 adjacent portion 26. Preferably, each fastening element 32 and 34 comprises a generally U-shaped clip having an elongated leg 36 and a short leg 38. The long leg 36 of each clip is preferably inserted through a slot formed in the associated belt portion and secured between layers of belt material, for example, by stitches. The shot leg 38 of each clip thus projects outwardly of and is spaced from the associated belt portion to form a hook-like projection. Clips 32 and 34, as illustrated in FIGS. 4–6, preferably open in a direction away from one another.

Holster 14 includes a holster body 40 having opposed side portions 42 and 44 stitched one to the other along their forward and rear edge portions to form a receptacle open at its upper end to receive the handgun H. Except for the flanges and fastening elements, which will now be described, the holster body may be of conventional construction. Holster body 40 hereof includes a pair of flanges 46 and 48 which are carried by and project forwardly and rearwardly from the forward and rear edge portions, respectively, of holster body 40. Each flange 46 and 48 may comprise two strips of material, preferably leather, stitched one to the other about their margins and also stitched between the edges of the holster side portions 42 and 44 along associated forward and rear edge portions of the holster. Thus, flange 46 projects forwardly from the forward edge portion of the holster body while flange 48 projects rearwardly from the rear edge of the holster body.

First and second fastening elements 50 and 52 are secured to the flanges 46 and 48. Preferably, each fastening element 50 and 52 comprises a D-shaped loop, forward of metal, with one leg of D-shaped loop being open at 54 (FIG. 3). Each flange is slit along its backside and adjacent its upper and lower edges as illustrated at 56 in FIG. 3. Thus, each D-shaped loop may be received through the slits 56 whereby the D-shaped loop is secured to the associated flange in a manner to project outwardly from the backside of holster body 40. It will be appreciated from a comparison of the orientation of the D-shaped loops or clips in FIGS. 4 and 5 that the D-shaped clips are carried by the holster for pivotal movement about substantially vertical axes. It will also be appreciated that the distance between the belt clips 32 and 34 when the elastic portion 26 is relaxed is less than the distance between the holster clips 50 and 52 thus necessitating a tensioning of the belt, as described hereinafter, to maintain the holster secured to the belt.

Having now described the basic structure of the belt and holster combination hereof, the manner of use of the belt and holster combination will now be described. Belt 12 may first be threaded through the loops 18 of the individual's pants and buckled about the individual in the usual manner but with tension being applied thereto to stretch the elastic portion 26. It will be appreciated from a review of FIG. 1 that the elastic portion 26 and clips 32 and 34 are thus located along the right or left side of the individual, depending upon the direction in which the belt is threaded through the pant loops, adjacent the location at which it is desired to carry the holster. With the belt thus secured about the individual and tensioned to stretch elastic portion 26, the holster body 40 is positioned so that one of its fastening elements may be secured to the corresponding fastening element carried by the belt. For example, the first holster fastening element comprised of D-loop clip 50 may be secured to the first belt fastening element comprised of clip 32 simply by inserting the outer leg of D-loop clip 50 into the opening of clip 32. It will be appreciated that the distal end of the outer leg 38 of each belt clip is spaced from the belt a distance slightly less than the thickness of the outer leg of the D-loop and that this requires a snap-like fastening action in order to force the outer leg of the D-loop clip through the belt clip opening and into proper seated position with clip 32. Having thus secured the first fastening elements of the belt and holster one to the other, the second fastening elements of the holster and belt may be secured one to the other in like manner. It will, of course, be appreciated and recognized that to insert the outer leg of the D-loop clip 52 into belt clip 34, the tension on elastic portion 26 must be relieved in order to locate the belt clip in position for receiving the second D-loop holster clip. Once inserted, and upon release of the belt, the belt will assume its tensioned position about the individual's waist with the belt clips 32 and 34 pivoting the D-loop holster clip into their outermost positions away from one another as illustrated in FIG. 4.

Alternatively, belt 12 may be threaded through the pant loops and left unbuckled. In this condition, the holster may be secured to the belt simply snapping the first and second D-loop clips past the ends of and into the first and second belt clips 32 and 34, respectively. Once the holster is clippd to the belt in this manner, the belt is tensioned and buckled. By tensioning the belt, the elastic portion is stretched enabling the D-loop holster clips to pivot away from one another into the position illustrated in FIG. 4.

To remove the holster from the belt without opening the belt or removing it from the individual wearing the holster, the D-loop clip of the first or the second fastening elements carried by the holster is removed from the corresponding clip carried by the belt. As previously described, the elastic portion 26 must first be relaxed to relieve the tension and to reduce the effective diameter of the belt in order to permit the first holster D-loop clip to be removed from the belt clip. Once this has been accomplished, the D-loop clip of the other fastening element carried by the holster may be removed from the corresponding belt clip by simply withdrawing it from the clip. Thus, the holster may be removed from the belt without opening the belt or otherwise removing it from the individual.

It will be apparent to those skilled in the art that various modifications and variations could be made in the holsters of the present invention without departing from the scope or spirit of the invention.

What is claimed is:

1. Apparatus for carrying a handgun comprising:

a holster for receiving a handgun and having first and second fastening elements spaced laterally one from the other a first predetermined distance, and a belt for carrying said holster and having an elastic portion and first and second fastening elements carried by said belt adjacent respective opposite end portions of said elastic portion and spaced laterally one from the other a second predetermined distance less than said first predetermined distance when said elastic portion lies in a relaxed condition, said first and second fastening elements carried by said belt and said first and second fastening elements carried by said holster being connected, respectively, one to the other when the belt is disposed about an individual and tensioned to stretch said elastic portion thereby to secure said holster to said belt.

2. Apparatus according to claim 1 wherein one of said first fastening elements includes a first clip secured to and projecting from one of said belt and said holster and opening in a lateral direction, the other of said first fastening elements including a projection carried by the other of said belt and said holster for reception through the opening of and within said first clip.

3. Apparatus according to claim 2 wherein one of said second fastening elements includes a second clip secured to and projecting from said one of said belt and said holster and opening in a lateral direction, the other of said second fastening elements including a projection carried by the other of said belt and said holster for reception through the opening of and within said second clip.

4. Apparatus according to claim 3 wherein the first and second fastening elements carried by one of said belt and said holster each include a substantially D-shaped loop, the first and second fastening elements carried by the other of said belt and said holster including said first and said second clips, said clips opening in the opposite lateral direction from one another.

5. Apparatus according to claim 4 wherein said D-shaped loops are pivotally carried by said one of said belt and said holster about axes generally perpendicular to the plane of said belt when said holster is secured to said belt.

6. Apparatus according to claim 4 wherein said first and second clips are carried by said belt, said first and second D-shaped loops being carried by said holster.

7. Apparatus according to claim 4 wherein said holster includes a holster body having a pair of flanges projecting from the opposite forward and rear edge portions thereof, respectively, said D-shaped loops or said clips being carried by said flanges.

8. Apparatus according to claim 4 wherein said holster includes a holster body, said D-shaped loops or said clips being pivotally carried by said holster adjacent the forward and rear edge portions, respectively, of said holster body.

* * * * *